US011919610B2

(12) United States Patent
Arnason

(10) Patent No.: US 11,919,610 B2
(45) Date of Patent: Mar. 5, 2024

(54) TRANSFER DEVICE FOR MOVING A STACK OF TUBS IN CARGO HOLD OF A VESSEL

(71) Applicant: Lambhusasund EHF., Akranes (IS)

(72) Inventor: Ingolfur Arnason, Akranes (IS)

(73) Assignee: Lambhusasund EHF., Akranes (IS)

( * ) Notice: Subject to any disclaimer, the term of this patent is extended or adjusted under 35 U.S.C. 154(b) by 234 days.

(21) Appl. No.: 17/432,903

(22) PCT Filed: Feb. 24, 2020

(86) PCT No.: PCT/IS2020/050003

§ 371 (c)(1),
(2) Date: Aug. 20, 2021

(87) PCT Pub. No.: WO2020/170274

PCT Pub. Date: Aug. 27, 2020

(65) Prior Publication Data

US 2022/0204139 A1 Jun. 30, 2022

(30) Foreign Application Priority Data

Feb. 22, 2019 (IS) ..... 050252

(51) Int. Cl.
*B63B 25/00* (2006.01)
*B63B 25/04* (2006.01)
(Continued)

(52) U.S. Cl.
CPC ..... *B63B 25/004* (2013.01); *B63B 25/04* (2013.01); *B63B 25/22* (2013.01); *B63B 25/24* (2013.01); *B63B 25/26* (2013.01); *B63B 35/24* (2013.01)

(58) Field of Classification Search
CPC ..... B63B 25/004; B63B 25/04; B63B 25/22; B63B 25/24; B63B 25/26; B63B 35/24
See application file for complete search history.

(56) References Cited

U.S. PATENT DOCUMENTS 3,214,057 A 10/1965 Box
6,059,521 A 5/2000 Rapeli
(Continued)

FOREIGN PATENT DOCUMENTS

CZ 286787 B6 7/2000
DE 4407048 A1 6/1995
(Continued)

OTHER PUBLICATIONS

International Search Report and Written Opinion dated Jun. 17, 2020 for corresponding International Application No. PCT/IS2020/050003.
(Continued)

*Primary Examiner* — Lynn E Schwenning
(74) *Attorney, Agent, or Firm* — TAROLLI, SUNDHEIM, COVELL & TUMMINO L.L.P.

(57) ABSTRACT

The present invention relates to system for managing cargo tubs in a cargo hold of a vessel, such as a fishing vessel. The functional components of the present invention comprise means such as stacking devices for loading the cargo hold with tubs and forming stacks, rails and wagons and pushing and pulling structures as transport means for transporting the stack of tubs.

10 Claims, 5 Drawing Sheets

(51) Int. Cl.

| | |
|---|---|
| ***B63B 25/22*** | (2006.01) |
| ***B63B 25/24*** | (2006.01) |
| *B63B 25/26* | (2006.01) |
| *B63B 35/24* | (2006.01) |

(56) References Cited

U.S. PATENT DOCUMENTS

| | | | | |
|---|---|---|---|---|
| 2002/0182035 | A1 | 12/2002 | Karlen | |
| 2013/0166062 | A1 | 6/2013 | Casey | |
| 2022/0204140 | A1 * | 6/2022 | Arnason | B63B 25/22 |

FOREIGN PATENT DOCUMENTS

| | | | | | |
|---|---|---|---|---|---|
| EP | 0475810 | | * | 3/1992 | B63B 25/00 |
| FR | 2584366 | A1 | | 1/1987 | |
| FR | 2591994 | | * | 6/1987 | B63B 27/22 |
| FR | 2621567 | A1 | | 4/1989 | |
| FR | 2633898 | | * | 1/1990 | B65B 35/14 |
| FR | 2633898 | A1 | | 1/1990 | |
| FR | 2681572 | A1 | | 3/1993 | |
| GB | 1219574 | A | | 1/1971 | |
| JP | S5679080 | A | | 6/1981 | |
| JP | S57189906 | A | | 11/1982 | |

OTHER PUBLICATIONS

Iceland Search Report dated Aug. 6, 2019 for corresponding Application No. SE 2019 00403a.

* cited by examiner

TRANSFER DEVICE FOR MOVING A STACK OF TUBS IN CARGO HOLD OF A VESSEL

RELATED APPLICATIONS

The present application is a U.S. National Stage application under 35 USC 371 of PCT Application Serial No. PCT/IS2020/050003, filed on 24 Feb. 2020; which claims priority from IS Patent Application No. 050252, filed 22 Feb. 2019, the entirety of both of which are incorporated herein by reference.

FIELD OF INVENTION

The present invention relates to an apparatus, system and method for managing tubs in cargo hold of a vessel. Moreover, the present invention provides a solution for transferring and arranging tubs and stacks of tubs in a cargo hold of fishing vessel in a safe and organised manner.

INTRODUCTION

Modern fishing vessels are becoming more and more advanced in preparing the fish for storing until it is processed on shore. Such vessels receive the catch on a pre-processing deck where the fish is gutted and bled to preserve the quality of the fish before it is placed in tubs for storage at a temperature close to zero degrees Celsius or even frozen. The value of the catch is increased if the pre-processing is efficient and the fish is bled properly and chilled to meet the expectations of the market.

In some of the more modern vessels it is possible to batch fish on board into tubs based on species, weight etc. WO 2018/185790 discloses such a system for tracing fish from gutting or gilling through batching and cooling using modern imaging technology and the speed of image and data processing to transport each fish under an image detecting device and obtain images to estimate size, weight, species and condition of fish prior to batching. After going through that process each batch of fish must be stored in a separate receptacle until delivered at shore.

Fish is normally kept in tubs during storing and transportation on fishing vessels. The tubs are normally stackable, such that the bottom structure of the tub fits into the opening of another tub. The bottom structure of each tub normally also comprises structural features for transport means such as forklifts to engage into. Management of the tubs in the cargo hold is then of importance, both with respect to tracing or knowing what is in each tub, but also how the tubs are arranged in the cargo hold of the fishing vessel. Managing tubs and stacks of tubs at sea, where constant movement of the vessel poses risk of the tubs falling over and also risk to the crew.

FR 2 621 567 discloses a system for handling containers in the cargo hold of a fishing vessel, where the containers are being arranged on either side of a longitutinal rolling path in the cargo hold, and where the system also comprises rails oriented transversely to the vessel. The system further comprises a carriage for transporting containers along the longitutinal rolling path and wherein a movable plate of the carriage is able to transport the containers along the rails oriented transversely to the vessel to transport the contains to each side of the rolling path.

SUMMARY OF THE INVENTION

The present invention relates to an apparatus, system and method for managing and securing cargo tubs in cargo holds such as storage/cooling/freezing facilities, a cargo hold of a vessel, such as a fishing vessel or food processing plants/factories. The apparatus, system and method are suitable for all kinds of cargo holds, but are specifically suitable for automatic cargo holds, unmanned cargo holds and cargo holds where space is limited. The cargo tubs are stackable tubs, where a portion of the bottom structure fits into the open upper surface of the tubs to lock the tubs at least partially together, such that a stack of tubs is tilted at least 17°, the stack will not fall apart. The tubs further have structural features for allowing transport means to attach to or lock into for moving a tub or stack of tubs. The system of the present invention is fully automatic, where a stack of tubs is formed in the cargo hold by delivering one or more tubs into the cargo hold. When a stack is formed it is automatically transported as a stack using locks, physical guides or barriers, rails and mechanical moving systems such as jacks and motors. The system, method and devices of the present invention can systematically deliver empty tubs to the processing deck and receive tubs filled with fish for storage in the cargo hold, where they are handled as stacks of tubs. When the vessel is in harbour, the tubs in the cargo hold are transported from the cargo hold and loaded off in an automatic manner using the moving transfer system in the cargo hold. Generally, the cargo hold is positioned below the deck where tubs are loaded with items, such as processing deck, where fish is pre-processed and chilled before it is transferred to cargo tubs. The tubs are then lowered to the cargo hold by a lifting mechanism. There, stacks are formed, and each stack is then transported to a storing location within the cargo hold. The method, the system and the apparatuses of the present invention provide a solution for feeding cargo tubs alone or in stacks into a cargo hold, to manage and arrange cargo tubs alone or in stacks in a cargo hold and to off-load cargo tubs alone or in stacks from or out of a cargo hold.

The present invention provides a device, system and method for transferring cargo tubs in a cargo hold of a vessel in a systematic, safe and secure manner. The functional components of the present invention comprise means such as lifts for loading the cargo hold with tubs and forming stacks, rails and wagons and pushing and pulling structures as transport means for transporting the stack of tubs. Furthermore, jacks and motors are used to operate the transport means in the cargo hold.

It is a big challenge to stack and transport tubs in a cargo hold of a ship at sea due to risk of a stack falling over spoiling the catch and being a severe security risk to the crew. Furthermore, the space within the cargo hold is valuable, so therefore it is also a challenge to use the cargo space as well as possible but still having the opportunity to transport tubs around the cargo hold for delivering of empty tubs to processing deck or for storing tubs in the cargo hold during fishing and transport. The present invention provides a solution to these problems with a fully automatic system and device for moving tubs in stacks around the cargo hold and providing means for delivering and receiving tubs to and from the cargo hold.

Synchronised and automatic moving mechanism systematically provides empty tubs from a row of empty tubs and arranges full tubs in that row using the apparatus and the system of the present invention. Devices of the apparatus presented herein providing pulling and pushing functions on the stacks of tubs and with the aid of transport/storing lanes, lifts and a wagon can transport tubs and stacks of tubs vertically in and out of the cargo hold and in two perpendicular directions in the cargo hold. The use of jacks, locks and motors to operate the pushing and pulling devices in addition to sensors, barriers and physical features of the tubs provide this fully automatic and safe system for arranging and transporting tubs in a cargo hold. In some embodiments of the present invention, the following features may be employed: a) use of a plurality of cargo lanes in a cargo hold for advancing and storing stacks of tubs in said cargo hold, b) by means of lifts to lower tubs down into the cargo hold and to form stacks of tubs at an in-feed end of each cargo lane, c) by providing a wagon for transporting a stack of tubs (one stack at a time) along a second direction of the cargo hold, either to off-load the cargo hold or to transfer a stack of tubs from one cargo lane to another, d) pushing devices for pushing one or more stacks of tubs along the cargo lane, and e) by means of a movable transfer lock positioned near one end of each cargo lane providing means for locking into the bottom structure of the bottom tub in a stack of tubs and pulling a stack into a wagon.

The present invention in useful in industry, not only for the purpose of enabling the currently existing equipment to operate at the ideal level of throughput, but also as a new standard of concentration control for which future devices can be designed to exploit.

It is an object of the present invention to overcome or ameliorate the aforementioned drawbacks of the prior art and to provide an improved and/or alternative and/or additional device for transferring and arranging cargo tubs in a cargo hold. Moreover, it is a preferred object of the present invention to provide an apparatus, a system and a method for transporting cargo tubs in and out of a cargo hold of a fishing vessel and to move tubs in stacks of tubs around the cargo hold in a fully automatic manner for providing empty tubs to a processing deck, to receive tubs filled with fish from a processing deck and to feed exit stacks of full tubs out of the cargo hold at shore. It is also a preferred object of the present invention to provide a method, a system and an apparatus having pushing and pulling devices synchronised with locks and barriers to arrange stacks of tubs in a cargo hold.

The object(s) underlying the present invention is (are) particularly solved by the features defined in the independent claims. The dependent claims relate to preferred embodiments of the present invention, which further relate to the apparatus, system and method of the present invention. Further additional and/or alternative aspects are discussed below.

Thus, at least one of the preferred objects of the present invention is solved by an apparatus for transferring cargo tubs in a cargo hold. The apparatus comprises i) two or more cargo lanes for storing and advancing stacks of tubs in a cargo hold along a first direction of the cargo hold from the in-feed end towards the out-feed end, ii) two or more pushing devices for pushing one or more stacks of tubs along each cargo lane, and iii) a wagon for transporting the stack of tubs along a second direction of the cargo hold. The apparatus further comprises iv) two or more stacking devices for forming a stack of tubs in the cargo hold, and v) pulling devices for pulling a stack of tubs at the out-feed end of one or more cargo lanes into the wagon.

The apparatus of the present invention operates with stackable tubs as are common in the fishing industry, where the tubs have an open upper surface and the bottom part of the tub has mating structures with the open upper surface for allowing stacking of two or more tubs in a stable stack. Furthermore, the bottom part of the tubs is designed with openings or other structural features for allowing pulling or stacking devices to engage into, such as fork-lift openings or the like.

In an embodiment of the present invention the cargo hold is a cargo hold of a fishing vessel, where the cargo hold is full of empty cargo tubs at the beginning of a tour. Tubs are transported out of the cargo hold up to the processing or pre-processing deck through one chosen cargo lane. This lane receives new stacks of tubs from other cargo lanes via the out-feed via a transport lane perpendicular to the cargo lanes, being positioned at the out feed end of all the cargo lanes and where a wagon can receive a stack of tubs from one cargo lane and transport said stack to the cargo lane feeding the processing deck. As tubs are continuously being filled with catch, new tubs are being lowered into the cargo hold by the lift for each cargo lane and therefore forming a new stack at the in-feed end of the lane as an empty stack is evacuated form the out-feed end of the lane and into the wagon. Therefore, the process of replacing a stack of empty tubs with full tubs is as follows:

a) Pushing means, such as a donkey, pushes a stack of tubs towards end of a cargo lane leaving the lift shaft empty and pushing one stack of tubs into the wagon.
b) The donkey is pulled back and the stack of tubs is fixed in its position by an upper lock, which locks into the opening of the upper most tub in the stack.
c) New tubs are lowered down into a cargo hold to form a new stack of tubs.
d) Steps a) to c) are repeated until all the empty tubs in the cargo lane have been pushed out and the cargo lane has been filled with full tubs in stacks.
e) When only the cargo lane feeding tubs out of the cargo hold and up to the pre-processing deck (the last lane) is left to fill, tubs filled with catch are transported by the wagon out of one or more of the other cargo lanes and into the last lane to fill the cargo hold with full tubs.

The process of loading the last two stacks of tubs into the wagon (where the donkey is not used to push the stacks, is as follows:

a) The movable lock engages into the bottom structure of the bottom tub in the stack next to the wagon and pulls that stack into wagon. As soon as that process is initiated, the upper locks are released. In the meantime, the fixed lock is engaged into the aft opening of the bottom structure of the bottom tub in the second last stack in the cargo lane with upper locks engaged into the opening of the upper most tub in the stack.
b) The movable lock returns to engage into the front opening of the bottom structure of the bottom tub in the second last stack in the cargo lane.
c) The fixed lock is disengaged, and the upper locks are released.
d) The movable lock pulls the now last stack into the wagon and then returns to a position nest to the donkey.

This process is also shown in FIG. 5. In order for secure movement of stacks of tubs along the cargo lanes and the transfer lane (in the wagon), the donkey, the fixed lock, the movable lock and the upper lock all have to be synchronized in their moving, engaging and disengaging.

Another preferred object of the present invention is solved by a system for transferring cargo tubs in a cargo hold of a vessel. The system comprises: i) two or more cargo lanes for storing and advancing stacks of tubs in a cargo hold along a first direction of the cargo hold from the in-feed end towards the out-feed end, ii) two or more pushing devices for pushing one or more stacks of tubs along each cargo lane, and iii) a wagon for transporting the stack of tubs along a second direction of the cargo hold. The system further comprises: iv) two or more stacking devices for forming a stack of tubs in the cargo hold, and v) pulling devices for pulling a stack of tubs at the out-feed end of one or more cargo lanes into the wagon.

The system of the present invention uses actuators such as jacks and motors for moving the lifts, the wagon, the pushing devices and the pulling devices. In order to operate the fully automatic system of the present invention, the movement of the lifts, the wagon, the pushing devices and the pulling devices are synchronized, which is facilitated by means of sensors 19 along the cargo and transport lanes as well as an industrial computer In an embodiment of the present invention each tub in stack of tubs have an open upper surface and the bottom portion comprises structures to fit into the open upper surface for allowing stacking of two or more tubs in a stable stack, and wherein the bottom portion further comprises openings or other structural features for allowing pulling or lifting devices to engage into.

In an embodiment of the present invention the two or more cargo lanes for storing and transporting stacks of tubs comprises a row of rollers. This is important for allowing advancing the stack of tubs along a first direction of the cargo hold.

In an embodiment of the present invention the one or more cargo lanes for storing and transporting stacks of tubs comprises one or more conveyors along each cargo lane.

In an embodiment of the present invention the pulling device and the pushing device are synchronised when moving stacks of tubs in the cargo hold.

In an embodiment of the present invention each of the cargo lanes are arranged with a pushing device for pushing a stack of tubs along the cargo lane.

In an embodiment of the present invention the one or more pushing devices for pushing one or more stacks of tubs along the cargo lane comprises a pushing bar for applying pressure (pushing force) lateral movement) onto two or more tubs in a stack.

In an embodiment of the present invention the wagon is arranged on a transport lane perpendicular to the direction of the cargo lanes at the out-feed end of the cargo lanes.

In an embodiment of the present invention the one or more pushing devices for pushing one or more stacks of tubs along the cargo lane is operated by hydraulic jacks.

In an embodiment of the present invention the pulling device comprises means for engaging or locking into a bottom structure of the lowest tub in a stack of tubs before pulling said stack of tubs into the wagon.

In an embodiment of the present invention the movable lock locks comprises lock-bars, which eject outwardly and perpendicularly from the transport direction of the cargo lane into openings or recesses in the bottom of the tubs.

In an embodiment of the present invention longitudinal rails are positioned along each side of the one or more cargo lanes in the upper and the lower part of the cargo hold to support the stack of tubs.

In an embodiment of the present invention the a fixed lock is positioned adjacent to the pulling device (the moveable lock) on the in-feed side to lock the stack next to the stack of tubs while the last stack of tubs is being transported into the wagon.

In an embodiment of the present invention sensors are used for determining the position of each stack of tubs in the cargo lanes or transport lanes.

In an embodiment of the present invention upper locking mechanisms are provided above the stacks of tubs in the cargo hold for participating in transferring the the stacks of tubs 6 along a cargo lane from above.

In an embodiment of the present invention the upper locks are synchronised with the fixed lock and the movable lock such that a set of upper locks operating with the fixed lock keep a stack of tubs fixed at the top and bottom of a stack while the upper locks operating with the movable lock move in a synchronised manner with the movable lock along the storing lane to secure movement of a row of stack of tubs in a storing lane at the top and bottom of a stack.

In an embodiment of the present invention an industrial computer is provided to control the moving part of the apparatus.

In an embodiment of the present invention actuators are used for moving the lifts, the wagon, the pushing devices and the pulling devices. Furthermore, the movement of the lifts, the wagon, the pushing devices and the pulling devices are synchronized using sensors along the cargo and transport lanes and an industrial computer.

At least another preferred object of the present invention is solved by a method for transferring cargo tubs in a cargo hold of a vessel. The method comprising the steps of: a) delivering a tub into the cargo hold through an entry opening using a stacking device to the in-feed end of a cargo lane, said stacking device forming a stack of tubs below the entry opening, b) transporting the stacks of tubs along a first direction of the cargo hold on the cargo lane by means of a pushing device, c) transporting the stack of tubs at the out-feed end of the cargo lane into a wagon by means of a pulling device, and d) transporting the stacks of tubs along a second direction of the cargo hold using one or more wagons. Furthermore, the pushing device pushes a stack of tubes along the cargo lane from the in-feed end towards the out-feed end during filling the cargo hold of stacks of tubs. Also, the pulling device transports the stack of tubs at the out-feed end into the wagon for transport in the second direction during emptying of a cargo lane or transfer of stack of tubs between parallel cargo lanes.

In an embodiment of the present invention the pulling device slides under the stack of tubs and pushes lock-members perpendicularly from the transport direction of the cargo lane into openings in the bottom structure of the lowest tub in the stack of tubs.

In an embodiment of the present invention the one or more stacking devices are lifts delivering tubs into the cargo hold where a fork is engaged in the bottom tub and the fork is lowered down into the cargo hold as new tubs are stacked onto the bottom tub, thereby forming a stack of tubs in the cargo hold.

In an embodiment of the present invention the wagon receives the stack of tubs at the out-feed end of the cargo lanes and transports the stack of tubs perpendicular to the direction of the cargo lanes from one cargo lane into another transport lane for either feeding empty tubs into the pre-processing deck or for offloading tubs filled with catch from the vessel In an embodiment of the present invention longitudinal rails are positioned along each side of the one or more cargo lanes for transporting the stack of tubs along the first direction of the cargo hold in the upper part of the cargo hold to prevent the tubs from moving perpendicular to the first direction of the cargo hold.

In an embodiment of the present invention the lock is a movable lock operating in the first direction of the cargo hold and advances a stack of tubs into the wagon.

In an embodiment of the present invention further comprising two or more stacking devices for forming a stack of tubs in the cargo hold.

In an embodiment of the present invention further comprising a wagon for transporting the cargo tubs along a second direction of the cargo hold.

In an embodiment of the present invention the pulling device comprises means for engaging or locking into a bottom structure of the cargo tubs.

In an embodiment of the present invention the pulling device is a movable lock operating in a direction along a cargo lane.

In an embodiment of the present invention the movable lock locks into an opening or indent in the bottom structure of a cargo tub for pulling a cargo tub or a stack of cargo tubs.

At least another preferred object of the present invention is solved by an system for transferring cargo tubs in a cargo hold of a vessel. The system comprises: i) two or more lifts for delivering tubs into the cargo hold, ii) two or more cargo lanes for storing and advancing stacks of tubs in a cargo hold along a first direction of the cargo hold from the in-feed end towards the out-feed end during loading of the cargo hold with tubs, and iii) a wagon for transporting the stack of tubs along a second direction of the cargo hold during emptying of a cargo lane or transfer of stack of tubs between parallel cargo lanes. The system further comprises: iv) two or more pushing devices for pushing one or more stacks of tubs along each cargo lane, v) pulling devices for pulling a stack of tubs at the out-feed end of one or more cargo lane into the wagon, and vi) upper locking mechanisms for participating in transferring the stacks of tubs 6 along a cargo lane from above. The system can optionally even further comprises sensors and an industrial computer, where the movement of the lifts, the wagon, the pushing devices and the pulling devices are synchronized by the industrial computer through actuators such as jacks and motors.

At least another preferred object of the present invention is solved by a system for transferring cargo tubs in a cargo hold. The system comprises i) two or more cargo lanes for storing and advancing stacks of tubs in a cargo hold along a first direction of the cargo hold from the in-feed end towards the out-feed end, ii) a plurality of cargo tubs, said cargo tubs having an open upper surface and a bottom portion comprising structures to fit into the open upper surface for allowing stacking of two or more tubs in a stable stack, and wherein the bottom portion further comprises structural engagement features such as openings, and iii) one or more pulling devices for pulling cargo tubs along the one or more cargo lane.

At least another preferred object of the present invention is solved by an apparatus for transferring cargo tubs in a cargo hold. The apparatus comprises: i) two or more cargo lanes for storing and advancing stacks of tubs in a cargo hold along a first direction of the cargo hold from the in-feed end towards the out-feed end, ii) a plurality of cargo tubs, said cargo tubs having an open upper surface and a bottom portion comprising structures to fit into the open upper surface for allowing stacking of two or more tubs in a stable stack, and wherein the bottom portion further comprises structural engagement features such as openings, iii) one or more pulling devices for pulling cargo tubs along the one or more cargo lane, wherein the pulling device comprises means for engaging or locking into a bottom structure of the lowest tub in a stack of tubs.

At least another preferred object of the present invention is solved by method for transferring cargo tubs in a cargo hold of a vessel. The method comprising the steps of:

a) delivering a cargo tub into the cargo hold through an entry opening using a stacking device, said stacking device forming a stack of tubs below the entry opening at the in-feed end of a first cargo lane,
b) transporting the stack of tubs along a first direction of the cargo hold on the first cargo lane by means of a pushing device,
c) transporting the stack of tubs from the out-feed end of the first cargo lane into a wagon by means of a pulling device,
d) transporting the stack of tubs along a second direction of the cargo hold using one or more wagons to feed the stack of tubs to further parallel cargo lanes,
e) repeating steps a)-d) while there are tubs and stacks of tubs to be transported from the first cargo lane to further cargo lanes.

In the present context the terms "tubs", "stackable tubs" and "cargo tubs" all relate to tubs, where a portion of the bottom structure fits into the open upper surface of the tubs to lock the tubs at least partially together. Such tubs are well known in the art and have been used for years in the fishing industry to store and transport fish from fishing grounds to factories or markets. A stack of the stackable tubs of the present invention cannot break in a transport lane of the invention with upper and lower longitudinal rail when the vessel is tilted from side to side during sailing. This is due to how the bottom structure fits into the open upper surface of the tubs to form a stable stack.

In the present context the terms "cargo lane" or "storage lane" "transport lane" or any combination thereof are used for rows for advancing and storing tubs in a cargo hold. The lanes have a bottom structure for tubs or stack of tubs to be pushed or pulled on for the purpose of either enter, store in or empty tubs or stacks of tubs from the lanes. These rows or lanes have structures, locks, pulling and pushing means to advance and secure tubs or stacks of tubs in the lanes.

In the present context the term "cargo hold" refers to a space in building or deck or a part of a deck on board a vessel, where cargo is transported into, stored and transported out of again.

In the present context the terms "Donkey" and "pushing means" both refer to a movable device arranged at one end of a cargo/transfer lane for pushing one or more stack(s) of tubs along the cargo/transfer lane. The pushing device is operated by an actuator such as a motor or a jack.

In the present context the term "wagon" refers to a movable structure which operates on a transfer lane or row and holds a stack of tubs securely in it. Physical barriers such as a frame and locks are a part of the wagon to secure a stack of tubs in the wagon during the transfer of a stack of tubs in the cargo hold.

In the present context the terms "first direction" or "X-direction" relate to the direction of the cargo lanes. In the embodiments shown in some of the drawings the first direction is along the length of the fishing vessel.

In the present context the terms "second direction" or "Y-direction" relate to the direction of the transfer lane of the wagon. In the embodiments shown in some of the drawings the first direction is between the starboard and the port of the fishing vessel.

In the present context wherein the movable lock and the fixed lock arranged at the out-feed end of a cargo/transport lane are used to transport the last stacks of tubs from the out-feed end of a cargo/transport lane and into the wagon in the absence or non-use of the pushing device (donkey).

BRIEF DESCRIPTION OF DRAWINGS

The present invention will be further described with reference to the drawings using reference numbers in the drawings to identify the individual components of the invention.

DETAILED DESCRIPTION OF THE PRESENT INVENTION

In the following, exemplary embodiments of the invention will be described, referring to the figures. These examples are provided to provide further understanding of the invention, without limiting its scope.

Figure 1:
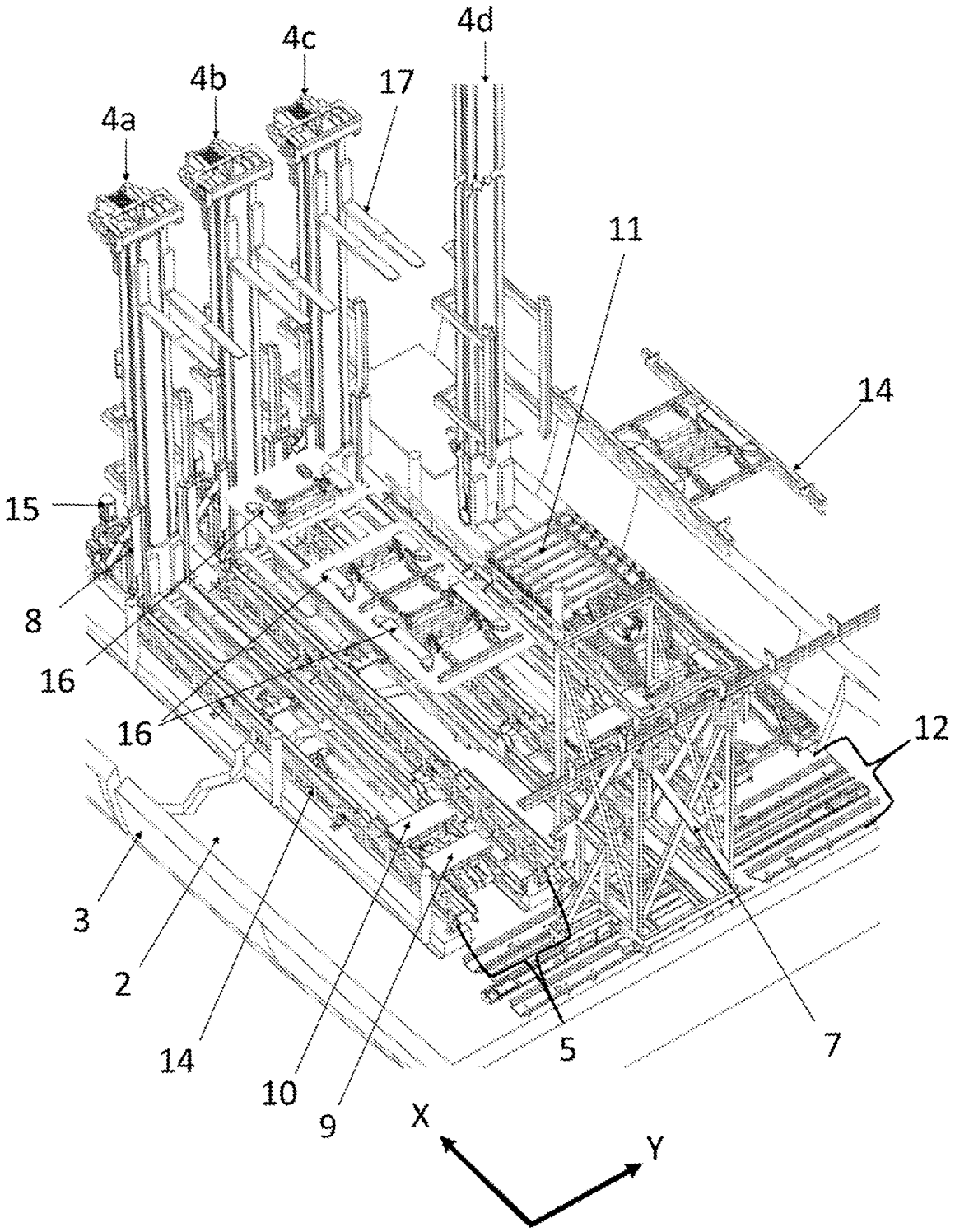
FIG. 1 shows the individual components of the in-feeding device of the present invention.

FIG. 1 shows a perspective view of the apparatus and system of the present invention seen from the side and above. The system has cargo lanes for transport and storing of tubs in stacks and lifts to transport tubs to and from a processing deck or in and out of the cargo hold. The setup shown in FIG. 1 has four transport and storage lanes with lifts where one top one lane is connected to a lift for transporting tubs in and out of the cargo hold and the other three lifts transport tubs to and from a processing deck. In such a set up one lane is used to transport empty tubs through an opening above the lift into the cargo hold, such as the middle lane for example. When a stack of tub is transported from any of the other lanes into the middle lane, a stack is pushed into the wagon and the wagon transports the stack of tubs in a direction perpendicular to the transport direction of the cargo lanes to the middle lane for advancement towards the lift and the opening into the processing deck. When tubs are loaded into a stack on each of the lifts from the processing deck, the full stack is then transported along the cargo lane. When the tubs are transported out of the cargo hold, pushing means (donkey) for each of the lanes not connected to the lift for transporting tubs in and out of the cargo hold pushes one stack at the time into the wagon and the wagon transports each stack to the lane connected to the lift for transporting tubs in and out of the cargo hold for off-loading. FIG. 1 shows a cargo hold 2 of a vessel 3 four lifts 4 for delivering tubs into the cargo hold 2. Lifts 4*a-c* are for transporting tubs to and from a processing deck, whereas lift 4*d* is for transporting tubs in and out of the cargo hold. The figure shows the cargo lanes 5 for storing stacks of tubs in a cargo hold 2 and for transporting stacks of tubs along a first direction of the cargo hold 2 and a wagon 7 for transporting the stack of tubs along a second direction of the cargo hold 2 on a transport line 12 arranged in the second direction in the cargo hold 2. As most of the lifts transport full tubs into the cargo hold the end of the storing and transport lane adjacent to the lifts is referred to as the in-feed end and the end of the storing and transport lane adjacent to the wagon is defined as the out-feed end, although this is in fact opposite for the lane feeding empty tubs up to the processing deck and for the lane feeding tubs out of the cargo hold by lift 4*d*. A pushing device 8 (donkey) is arranged by each of the lifts for pushing the stacks of tubs along the cargo lane 5. A set of locks are arranged near the outfeed end of each storing and transport lane 5 for managing the transport of the stacks of tubs (one at a time) into the wagon 7 for transport of a stack of tubs into another transport lane 5. The locks are divided into a movable transporting lock or pulling device 9 for pulling the stack of tubs along the one or more cargo lane 5 into the wagon 7 and a fixed lock 10. The system has a plurality of actuators 15 for moving the lifts 4, the wagon 7, the pushing devices 8 and the pulling devices 9 in the cargo hold. The actuators 15 can be motors or jacks, such as hydraulic jacks. The drawing also a set of upper locks 16 at the in-feed end and the outfeed end. The in-feed end upper locks 16 hold the stack of tubs as a new stack of tubs is being lowered by a lift 4 into the cargo hold 2. The outfeed end upper locks 16 hold the second last stack of tubs at the outfeed end as the last stack of tubs at the outfeed end is being loaded into the wagon 7. As shown in the drawing the lifts 4*a-d* have carrying means such as forks 17 for loading or unloading a stack of tubs into or out of the cargo hold. The drawing also shows a set of rollers 11 forming the advancing portion of the cargo lane 5. The drawing further shows upper and lower longitudinal rails 14 are positioned along each side of the one or more cargo lanes for transporting the stack of tubs along the first direction of the cargo hold.

Figure 2:
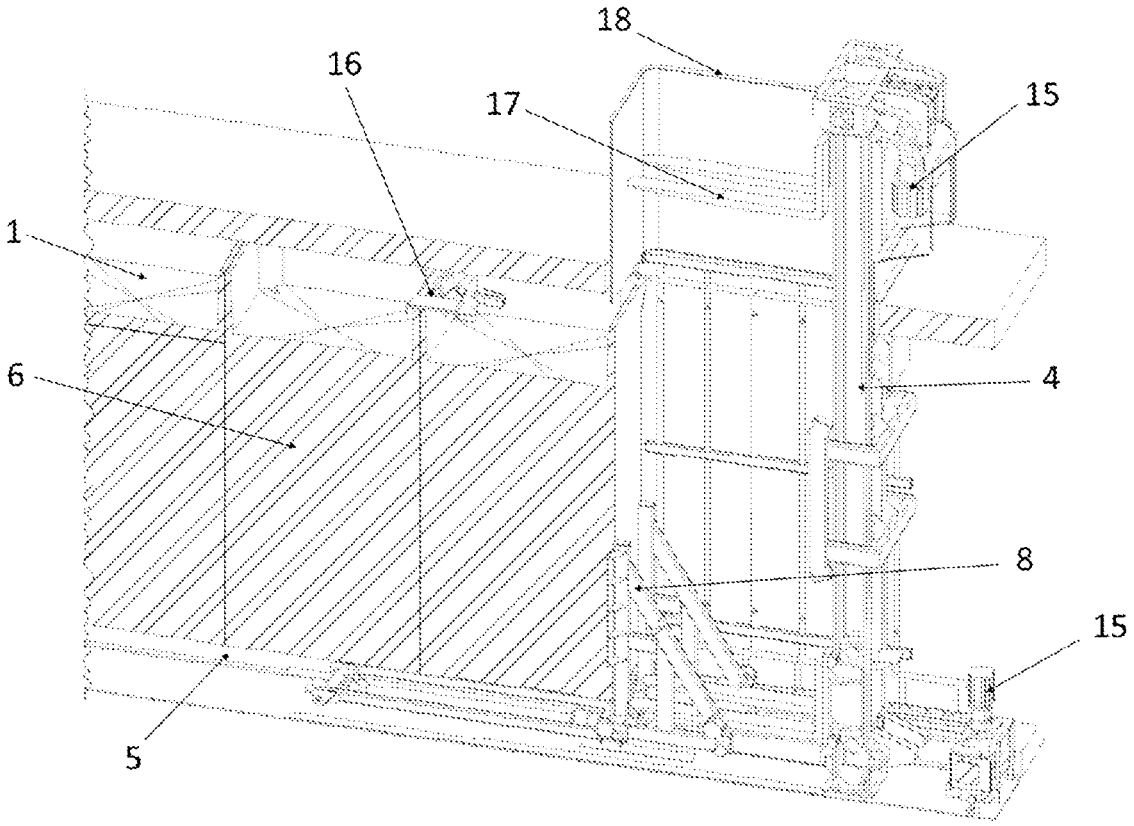
FIG. 2 shows a side view (A) of the grading apparatus and thein-feeding device. A top view (B) of the same equipment.

FIG. 2 shows a perspective side-view of the in-feed end of a cargo lane 5 for stacks of tubs 6. The drawing shows an opening 18 into the cargo-hold and a lift 4 with a fork 17 for loading a stack of tubs 6 into the cargo-hold. The pushing device 8 is arranged below the opening 18 for pushing the stacks of tubs 6 along the cargo lane 5. The drawing shows two actuators 15 for moving the lift 4 and the pushing device 8. An upper lock 16 at the in-feed end is also shown for holding a stack of tubs in place as the pushing means backs up to fetch a new stack of tubs 6. The upper lock is shown lock is shown locking into the top tub 1, but the drawing shows the inside of the top tub 1 in a stack of tubs 6.

Figure 3:
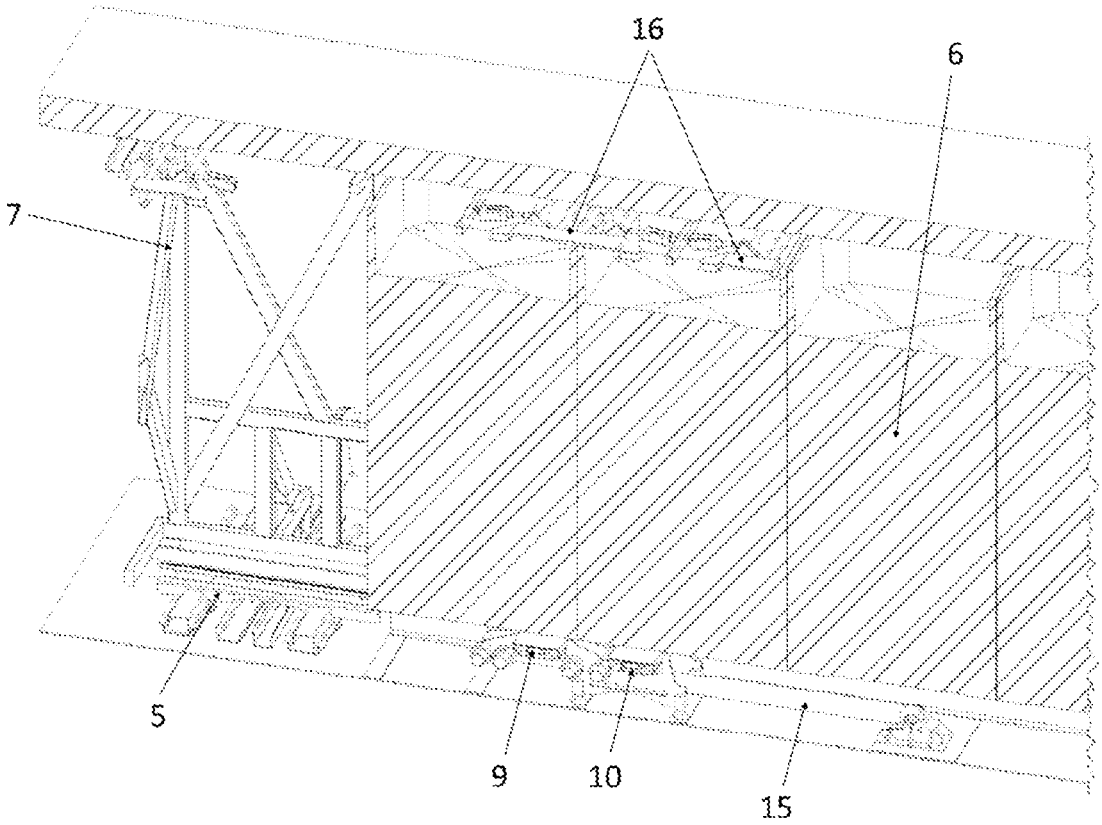
FIG. 3 shows a perspective drawing of the in-feed device of the present invention.

FIG. 3 shows a perspective side-view of the out-feed end of a storing/transport lane 5 for stacks of tubs 6. The drawing shows the wagon 7 for transferring a stack of tubs 6 in a direction perpendicular to the direction of the transport direction of the storing/transport lanes 5. A set of locks are arranged on the storing/transport lane 5 for holding one stack of tubs in a fixed position and transporting another stack of tubs into the wagon. A pair of upper locks 16 at the outfeed end also assist with stabilizing and transfer of the stacks of tubs as the last stack of tubs 6 is being transferred into the wagon 7. The drawing shows the movable lock 9 and the fixed lock 10 as well as an actuator 15 for moving the movable lock 9, which in this case is a jack.

Figure 4:
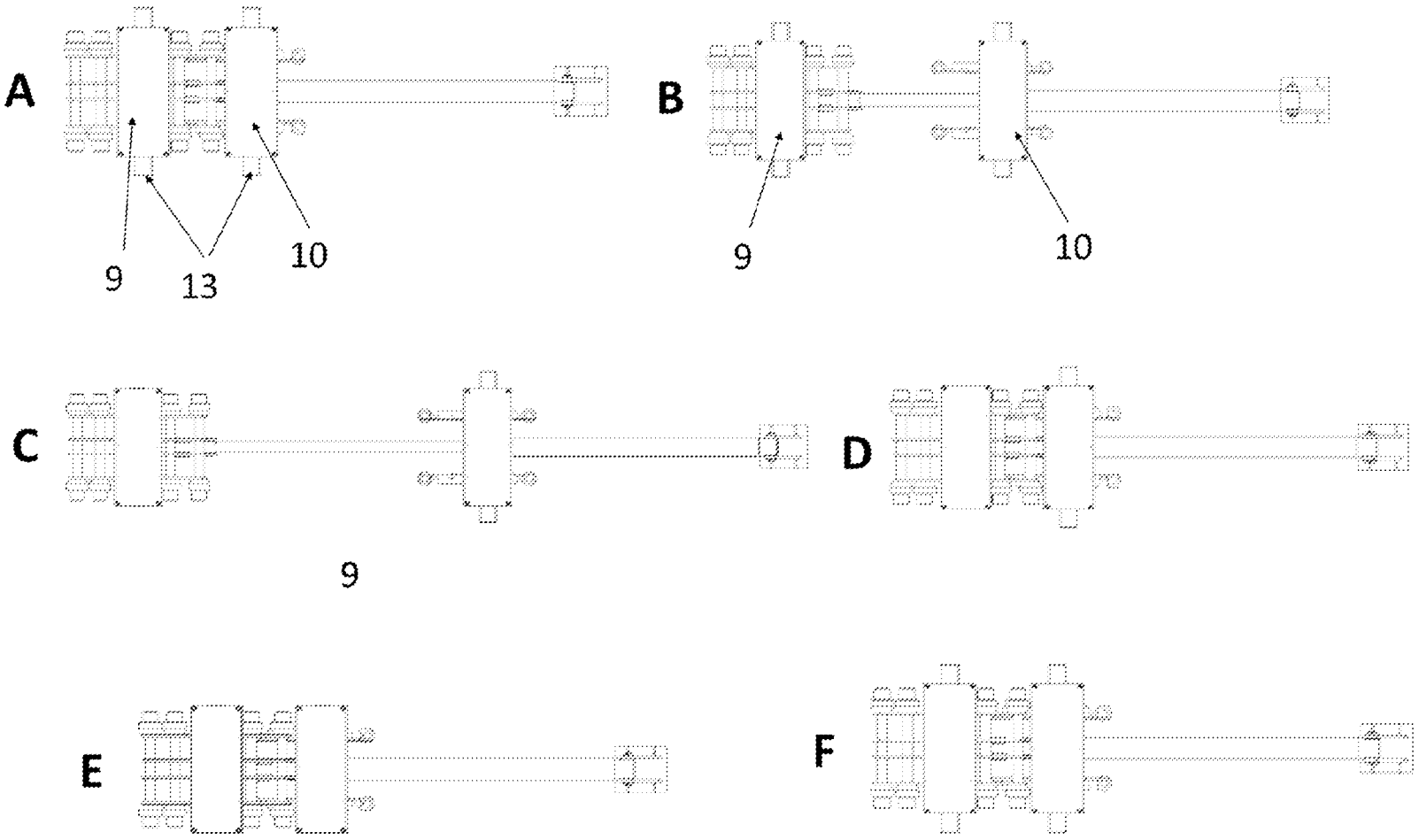
FIG. 4 shows a top view of the in-feed device of the present invention.

FIG. 4 is a top view of the fixed lock 10 and the movable lock 9 as a stack of tubs is being transferred into the wagon (tubs and wagon not shown). The drawing shows a sequence of the position of the locks and the engagement of the locking means 13 in each position as a stack of tubs is being transferred into the wagon. In the first position (A) the fixed lock 9 and the movable lock 9 are in adjacent positions where the locking means 16 is locked into two adjacent stacks of tubs. In the second position (B) the movable lock 9 is pulling a stack of tubs into the wagon, where the locking means 13 is engaged in both locks. In the third position (C) the movable lock 9 has released the stack of tubs in the wagon and the locking means 13 is not engaged. The movable lock 9 is now ready to be moved back to being adjacent to the fixed lock 10 in the fourth position (D) shown in the drawing. In the fifth position (E) the fixed lock 10 and the movable lock 9 are in adjacent positions where the locking means 13 is not engaged and a stack of tubs can be pushed along the storing/transfer lane to position the next stack of tubs adjacent to the wagon. In the sixth position (F) the fixed lock 10 and the movable lock 9 are still in adjacent positions with the locking means 13 engaged again in two adjacent stacks of tubs.

Figure 5:
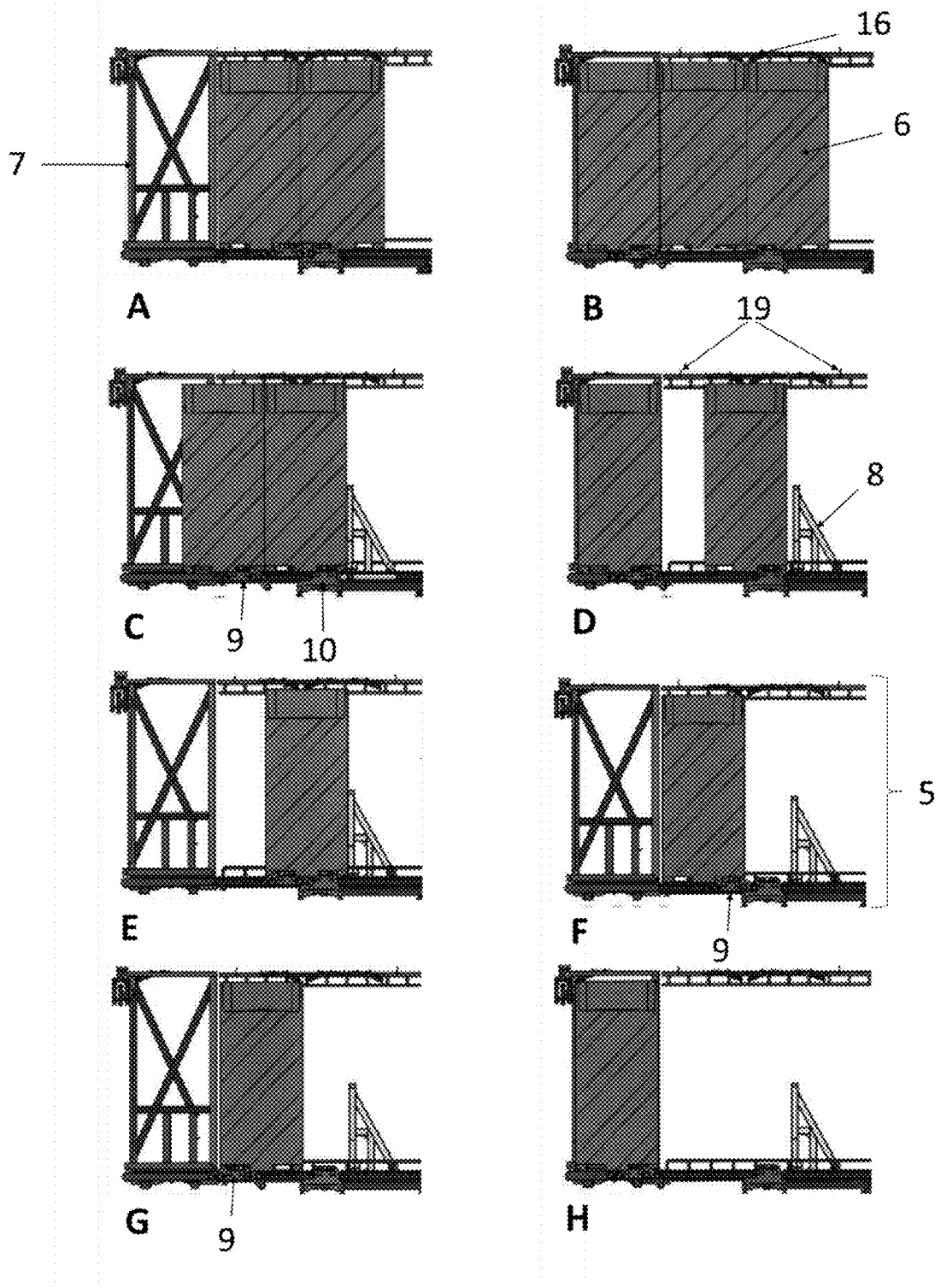
FIG. 5 outlines the transfer of stacks of tubs one by one into a wagon until the transport/storing lane is empty.

FIG. 5 shows how pushing devices and pulling devices are used together to transport stacks of tubs 6 along the transport/storing lanes 5 in the cargo hold. The figure shows how stacks of tubs 6 are transferred one by one into the wagon 7 until the transport/storing lane is empty. The pushing devices 8 and pulling devices 9 are synchronised together with the upper locks 16 to move stacks of tubs 6 into the wagon 7. FIG. 5A shows an empty wagon 7 and two adjacent stacks tubs 6 next to the wagon 7. Each tub has two openings on each side in the bottom surface of the tub for the locks to lock into. The movable lock 9 (the pulling device) is locked into the aft opening (further away from the wagon) of the tub next to the wagon and the fixed lock 10 is locked into the front opening of the tub adjacent to the tub next to the wagon. In FIG. 5B the stack of tubs has been pulled into the wagon and two adjacent stacks of tubs are shown waiting in line to be transported into the wagon. The figure also shows that the movable lock 9 is still locked into the bottom portion of the bottom tub showing that the bottom lock can pull a stack of tubs all the way into the wagon. FIGS. 5C-H show how the remaining two stacks of tubs are transported out of the storing/transport lane. The donkey (pushing device) 8 pushes the last two stacks of tubs onwards such that the last stack of tubs is half-way into the wagon (FIG. 5C). The movable lock is locked into the aft opening of the tub half-way into the wagon and pulls this stack of tubs into the wagon 7, whereas the fixed lock is locked into the front opening of the tub adjacent to the tub being transferred into the wagon (FIG. 5D). In FIG. 5E the wagon has been emptied and is ready for the last stack of tubs in the storing/transport lane. The movable lock has returned to pick up the last stack of tubs and the donkey has reached the end position in front of the fixed lock 10. The movable lock 9 locks into the front opening of the bottom tub and pulls the last stack of tubs in a position next/adjacent to the wagon. In FIG. 5F the moveable lock moves to lock into the aft opening of the bottom tub of the last stack of tubs and pulls the stack into the wagon (FIG. 5H)

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. An apparatus for transferring cargo tubs in a cargo hold of a vessel, the apparatus comprising:

a cargo lane configured to store and advancing one or more stacks of cargo tubs in a cargo hold along a first direction of the cargo hold from an in-feed end towards an out-feed end;

a pushing device configured to push the one or more stacks of cargo tubs along the cargo lane and comprising a pushing bar configured to applying a lateral pushing force onto the one or more stacks of cargo tubs;

a wagon configured to transport the one or more stacks of cargo tubs along a second direction of the cargo hold;

a stacking device configured to form the one or more stacks of cargo tubs in the cargo hold; and a pulling device configured to pull the one or more stacks of cargo tubs at the out-feed end of the cargo lane into the wagon; and a lock positioned adjacent to the pulling device on the in-feed end and configured to lock into a bottom structure of a lowest tub of the one or more stacks of cargo tubs.

2. The apparatus according to claim 1, wherein the cargo lane comprises a row of rollers.

3. The apparatus according to claim 1, wherein the cargo lane is arranged with the pushing device for pushing the one or more stacks of cargo tubs along the cargo lane.

4. The apparatus according to claim 1, wherein the wagon is arranged on a transport lane perpendicular to the direction of the cargo lane at the out-feed end of the cargo lane.

5. The apparatus according to claim 1, further comprising sensors configured to determine the position of each of the one or more stacks of cargo tubs in the cargo lane or a transport lane.

6. The apparatus according to claim 1, further comprising an upper lock configured to participate in transferring the one or more stacks of cargo tubs along the cargo lane.

7. A method for transferring cargo tubs in a cargo hold of a vessel, the method comprising the steps of:

a) delivering a cargo tub into a cargo hold through an entry opening using a stacking device, said stacking device forming a stack of cargo tubs below the entry opening at an in-feed end of a first cargo lane;

b) transporting the stack of cargo tubs along a first direction of the cargo hold on the first cargo lane by a pushing device;

c) transporting the stack of cargo tubs from an out-feed end of the first cargo lane into a wagon by using a pulling device;

d) transporting the stack of cargo tubs along a second direction of the cargo hold using one or more wagons to feed the stack of cargo tubs to further cargo lanes;

e) repeating steps a)-d) while there are cargo tubs and stacks of cargo tubs to be transported from the first cargo lane to the further cargo lanes.

8. The method according to claim 7, wherein the pulling device slides under the stack of cargo tubs and pushes lock-members perpendicularly from the transport direction of the first cargo lane into openings in the bottom structure of the lowest tub in the stacks of cargo tubs.

9. The method according to claim 7, wherein the wagon receives the stack of cargo tubs at the out-feed end of the first cargo lane and transports the stack of cargo tubs perpendicular to the direction of the further cargo lanes from one of the further cargo lanes into another cargo lane for either feeding empty cargo tubs into a pre-processing deck or for offloading cargo tubs filled with catch from a vessel.

10. The method according to claim 7, wherein the pulling device comprises a movable lock operating in the first direction of the cargo hold and advances the stack of cargo tubs into the wagon.

* * * * *